US010501889B2

(12) United States Patent
Abraham et al.

(10) Patent No.: US 10,501,889 B2
(45) Date of Patent: Dec. 10, 2019

(54) EXTRUDED PAPER MACHINE CLOTHING AND METHOD FOR THE PRODUCTION THEREOF

(71) Applicant: VOITH PATENT GMBH, Heidenheim (DE)

(72) Inventors: Juergen Abraham, Nattheim (DE); Antony Morton, Ben Rhydding (GB)

(73) Assignee: Voith Patent GmbH, Heidenheim (DE)

( * ) Notice: Subject to any disclaimer, the term of this patent is extended or adjusted under 35 U.S.C. 154(b) by 356 days.

(21) Appl. No.: 15/325,296

(22) PCT Filed: May 11, 2015

(86) PCT No.: PCT/EP2015/060333
§ 371 (c)(1),
(2) Date: Jan. 10, 2017

(87) PCT Pub. No.: WO2016/005083
PCT Pub. Date: Jan. 14, 2016

(65) Prior Publication Data

US 2017/0183819 A1 Jun. 29, 2017

(30) Foreign Application Priority Data

Jul. 10, 2014 (DE) ..... 10 2014 213 444

(51) Int. Cl.
*D21F 1/00* (2006.01)
*D21F 7/08* (2006.01)
(Continued)

(52) U.S. Cl.
CPC ..... *D21F 1/0027* (2013.01); *D01D 5/08* (2013.01); *D04H 3/045* (2013.01); *D04H 3/14* (2013.01);
(Continued)

(58) Field of Classification Search
CPC .... D21F 1/0027; D21F 1/0036; D21F 1/0045; D21F 1/0063; D21F 1/0081; D21F 7/08; D21F 7/083; D21F 7/12
(Continued)

(56) References Cited

U.S. PATENT DOCUMENTS 6,733,833 B2 5/2004 Ampulski
2001/0051224 A1* 12/2001 Ampulski ..... B29C 43/28 427/424
(Continued)

FOREIGN PATENT DOCUMENTS

EP 1045066 A2 10/2000
EP 1567322 B1 11/2003
(Continued)

*Primary Examiner* — Eric Hug
(74) *Attorney, Agent, or Firm* — Laurence A. Greenberg; Werner H. Stemer; Ralph E. Locher

(57) ABSTRACT

A clothing for a machine producing and/or processing a fibrous web extending in longitudinal and widthwise directions, includes a basic structure providing dimensional stability in longitudinal and/or widthwise directions. The structure includes a band-shaped, one-piece grid having widthwise-adjacent first material strands and polymer material having lengths in a longitudinal direction, and adjacent second interconnected material strands and/or droplets and polymer material, contacting the first strands at contact points forming the grid. The strands and/or droplets are deposited by extrusion of the polymer materials in liquid or pasty state onto a depositing surface forming a portion or all of the grid in liquid or pasty state, the polymer materials are solidified, converting the portion or the grid from liquid or pasty to solidified, stable, self-supporting state producing bonding at the contact points, and removing the portion or the grid from the surface.

27 Claims, 6 Drawing Sheets

(51) Int. Cl.

| | |
|---|---|
| ***D21F 7/12*** | (2006.01) |
| ***D01D 5/08*** | (2006.01) |
| ***D04H 3/045*** | (2012.01) |
| ***D04H 3/14*** | (2012.01) |

(52) U.S. Cl.
CPC ..... *D21F 1/0054* (2013.01); *D21F 1/0063* (2013.01); *D21F 1/0081* (2013.01); *D21F 7/083* (2013.01); *D21F 7/12* (2013.01); *D10B 2331/02* (2013.01); *D10B 2331/04* (2013.01); *D10B 2331/10* (2013.01); *D10B 2331/301* (2013.01)

(58) Field of Classification Search
USPC .... 162/116, 296, 348, 358.2, 362, 900, 902, 162/903
See application file for complete search history.

(56) References Cited

U.S. PATENT DOCUMENTS

| | | | | |
|---|---|---|---|---|
| 2005/0280184 | A1* | 12/2005 | Sayers | D04H 3/02 264/308 |
| 2010/0137089 | A1* | 6/2010 | Cunnane | D21F 11/006 474/268 |
| 2011/0244132 | A1* | 10/2011 | Jeffery | D21F 1/0027 427/280 |
| 2014/0272269 | A1* | 9/2014 | Hansen | D21F 1/0036 428/111 |

FOREIGN PATENT DOCUMENTS

| | | | |
|---|---|---|---|
| EP | 1612327 | A2 | 1/2006 |
| GB | 2202873 | A | 10/1988 |
| WO | 9217643 | A1 | 10/1992 |
| WO | 2014150476 | A1 | 9/2014 |

* cited by examiner

EXTRUDED PAPER MACHINE CLOTHING AND METHOD FOR THE PRODUCTION THEREOF

BACKGROUND OF THE INVENTION

Field of the Invention

The invention relates to a clothing for a machine producing and/or processing a fibrous web, in particular a paper, board or tissue web, and also to a process for the production thereof.

The clothings known today are generally produced by textile production processes, i.e. for example by weaving warp and weft threads and/or needling one or more layers of nonwovens. The textile production processes are time-consuming, and therefore cost-intensive. For this reason, in the past there have repeatedly been proposals suggesting alternative production technologies for producing the clothings mentioned at the beginning.

Thus, for example, it is proposed in EP1567322 to produce a clothing for a paper, board or tissue machine by what is known as SDM (selective deposition modelling), in which the clothing is built up polymer layer by polymer layer. Although such a production process is very flexible, it has the disadvantage that the layer-by-layer buildup of the clothing is time-consuming, and the clothings thereby produced do not have the required strength for use in a machine producing a fibrous web.

For the production of clothings with a structured side in contact with the fibrous web, for producing tissue paper, it is proposed for example in U.S. Pat. No. 6,733,833 to extrude material strands of polymer material onto the upper side of a textile band, the material strands then providing the topographical structure of the upper side of the clothing. Such extruded surface structures can be produced easily and quickly, but so far they have only been created on the textile band for decorative purposes, in order to provide a clothing with which the tissue paper produced on it has a certain feel and appearance.

SUMMARY OF THE INVENTION

The object of the present invention is to propose a clothing that has a load-absorbing basic structure comprising a grid structure that can be produced quickly, flexibly and at low cost and a process for the production thereof.

The object is achieved by a clothing according to the invention and a process for the production thereof according to the invention. According to the first independent aspect of the invention, a clothing that extends in a lengthwise direction and a widthwise direction is proposed for use in a machine producing and/or processing a fibrous web, the clothing having a basic structure that substantially provides the dimensional stability of the clothing in the lengthwise direction and/or widthwise direction in the use thereof as intended. Here, the basic structure comprises a grid structure in band form and in one piece, which has a number of first material strands, which are arranged next to one another in the widthwise direction of the clothing, comprise a first polymer material and extend in their length substantially in the lengthwise direction of the clothing, and also a number of second material strands and/or drops, which are arranged next to one another, comprise a second polymer material, contact the first material strands at contact points and are connected to one another in such a way that the first material strands and the second material strands and/or drops together form the grid structure in band form and in one piece. The grid structure has been produced by the first material strands and the second material strands and/or drops:

a. having been deposited in a liquid or pasty state by extrusion of the first and second polymer materials in a liquid state onto a depositing surface for the forming of the grid structure in band form,
b. the first and second polymer materials having been solidified, whereby the grid structure was transformed from the liquid or pasty state into a solidified stable and self-supporting state, and a material-bonded connection having been established at the contact points, and
c. the solidified grid structure in band form having been removed from the depositing surface.

The invention proposes a clothing in which the grid structure of the load-absorbing basic structure has been produced by an extrusion process. Such a grid structure produced by an extrusion process can be created quickly, flexibly and at low cost. Since in the case of an extrusion process reinforcing yarns and/or fibres and/or particles can also be extruded at the same time with the liquid or pasty polymer material in the production of the material strands, and these reinforcing yarns and/or fibres and/or particles are then at least partially embedded in the polymer material, a grid structure that is dimensionally stable and absorbs the tensile load in a clothing can be created by this process.

According to a second independent aspect of the invention, a process for producing a clothing for a machine producing and/or processing a fibrous web is proposed, the clothing having a basic structure that substantially provides the dimensional stability of the clothing in the lengthwise direction and/or widthwise direction in the use thereof as intended, the basic structure having a grid structure in band form and in one piece and the process for producing the grid structure in band form and in one piece comprising the following steps:

a. providing a depositing surface having a first direction and a second direction,
b. providing a first and a second polymer material in a liquid state,
c. extruding the liquid first polymer material by means of at least one nozzle in such a way that on the depositing surface there are formed a multiplicity of first material strands, which are arranged next to one another in the second direction and are spaced apart from one another and in their length respectively extend substantially in the first direction,
d. extruding the liquid second polymer material by means of at least one nozzle in such a way that on the depositing surface there are formed a multiplicity of second material strands and/or drops, which are arranged next to one another in the first direction and are spaced apart from one another and contact the first material strands at contact points and are connected to one another in such a way that the first material strands and the second material strands and/or drops together form at least a portion of the grid structure,
e. transforming the at least one portion of the grid structure from a liquid or pasty and unstable state into a solidified and self-supporting state by
   1. solidifying the first polymer material,
   2. solidifying the second polymer material and also
   3. bringing about a material-bonded connection between the first and second polymer materials at the contact points, and f. removing the at least one portion of the solidified grid structure in band form from the depositing surface.

The invention proposes a process for producing the transporting band according to the invention in which the load-absorbing structure comprises a grid structure produced by an extrusion process. Such a grid structure produced by an extrusion process can be produced quickly, flexibly and at low cost. Since in the case of an extrusion process reinforcing yarns and/or fibres and/or particles can also be extruded at the same time with the liquid polymer material in the production of the material strands, and these reinforcing yarns and/or fibres and/or particles are then at least partially embedded in the polymer material, a grid structure that is dimensionally stable and absorbs the tensile load in a clothing can be created by this process.

Preferably, particularly the lengthwise direction of the clothing or basic structure is the intended machine direction and the widthwise direction of the clothing or basic structure is the intended cross machine direction when the clothing is used as intended in the machine for producing a fibrous web. Furthermore, the lengthwise direction of the clothing and of the basic structure coincide, as does the widthwise direction of the clothing and of the basic structure.

Furthermore, it should be noted that the length of the respective structure or of the clothing is the respective extent thereof in the lengthwise direction thereof and the width of the respective structure or clothing is the respective extent thereof in the widthwise direction thereof.

For the purposes of the invention, a material strand is intended to be understood as meaning a portion of material that has a length which is greater in comparison with its height and width by at least a factor of 100.

For the purposes of the invention, a material drop is intended to be understood as meaning a portion of material in which one of the dimensions height, length and width is greater than the other of the dimensions height, length and width by at most a factor of 10.

The longitudinal edges of the structure concerned (i.e. grid structure or basic structure) or clothing are intended to be understood as meaning the edges that extend in the lengthwise direction of the structure or clothing concerned and bound it in width. The transverse edges of the structure concerned (i.e. grid structure or basic structure) or clothing are intended to be understood as meaning the edges that extend in the transverse direction of the structure or clothing concerned and bound it in length.

When the length of the grid structure is mentioned in the context of the present invention, this should be understood as meaning the extent thereof in the lengthwise direction of the basic structure and the clothing. When the width of the grid structure is mentioned in the context of the present invention, this should be understood as meaning the extent thereof in the widthwise direction of the basic structure and the clothing.

For the purposes of the invention, the grid structure is always formed in band form, i.e. in the form of a band, and in one piece, i.e. of a single piece that can only be transformed into a number of pieces by destroying it. The designations "grid structure" or "grid structure in band form" or "grid structure in band form and in one piece" are therefore to be understood as synonymous in the context of this application.

It goes without saying that the grid structure in band form and in one piece does not have to be produced in its entire length and width before it is removed from the depositing surface. It is thus also conceivable that a number of portions of the grid structure that together provide the grid structure in one piece and in band form are produced one following after the other. It is thus conceivable that, in repeated succession, only a portion of the grid structure is respectively extruded, and in each case thereafter solidified and subsequently removed from the depositing surface. It is also conceivable however that the grid structure is first extruded completely before it is solidified and removed from the depositing surface. In the context of the invention, the grid structure or the portion of the grid structure is a finished product when it has been solidified and the material-bonded connection established and it has been or can be removed from the depositing surface.

Advantageous refinements and developments of the invention are specified in the subclaims.

The grid structure in band form may be produced here with a length and/or width that corresponds at least to the length and/or width of the basic structure to be produced and with a smaller length and/or width than the basic structure to be produced.

In the first-mentioned case, the grid structure may then be made to the length and/or width of the basic structure. Furthermore, the basic structure may be (completely) formed by the grid structure, to be precise for example whenever the grid structure is for example already produced continuously. If the grid structure is produced flat with at least the length and/or width of the basic structure, it may be made to the length and/or width of the basic structure and, to make it continuous, be connected by means of a seam connecting means at the two transverse edges that are spaced apart from one another in the lengthwise direction.

In the second-mentioned case, i.e. in the case in which the width of the grid structure in band form is smaller than the basic structure to be produced, the basic structure may be formed from the grid structure in band form by the grid structure in band form being wound helically, with turns that run around in the lengthwise direction of the basic structure and progress in the widthwise direction. As an alternative to this, the basic structure may be formed from the grid structure in band form by the basic structure being formed by a number of strips of the grid structure that are disposed next to one another in the widthwise direction and are connected to one another along their longitudinal edges.

Preferably, both the first material strands and the second material strands and/or drops are made up substantially, i.e. to over 50% by weight, of the first or second polymer material. Specifically, the first material strands may be formed to at least 60% by weight, in particular at least 80% by weight, by the first polymer material. Furthermore, the second material strands and/or drops may be formed to at least 60% by weight, in particular at least 80% by weight, by the second polymer material.

With regard to the production process, the first direction of the depositing surface and the lengthwise direction of the clothing to be produced preferably coincide, as does the second direction of the depositing surface and the widthwise direction of the clothing to be produced. Furthermore, the length of the basic structure corresponds to the length of the clothing and the width of the basic structure corresponds to the width of the clothing.

The depositing surface used in the case of the process may for example be provided by a depositing band or a depositing roller, with a circumferential direction extending at least in some portions in the first direction, which band or roller runs around in its circumferential direction during the extrusion.

A specific refinement of the process according to the invention provides that the first and second polymer materials are extruded by means of the at least one nozzle, the at least one nozzle and the depositing surface moving in such a way in relation to one another in the first and/or second direction during the extrusion.

Various possibilities are conceivable here, some of which are enumerated below, the enumeration not being exhaustive.

It is thus conceivable that the depositing band or the depositing roller extends in the second direction at least over the intended extent of the clothing in the widthwise direction thereof. In this case, it is particularly conceivable that the at least one nozzle is moved in the second direction during the extrusion. As an alternative to this, it is also conceivable that the depositing band or the depositing roller extends in the second direction only over part of the intended extent of the clothing in the widthwise direction thereof. In this case, it is particularly conceivable that the at least one nozzle and the depositing band or the depositing roller are moved in the second direction during the extrusion.

Specifically, a number of nozzles arranged next to one another in the second direction may be used for the extrusion of the first material strands, through which nozzles the first polymer material is extruded at the same time.

Furthermore, a number of nozzles arranged next to one another in the first direction may be used for the extrusion of the second material strands and/or drops, through which nozzles the second polymer material is extruded at the same time. As an alternative to this, a number of nozzles arranged next to one another in the second direction may be used for the extrusion of the second material drops—which nozzles may in particular be the same nozzles through which the first material strands are produced, and through which the second polymer material is extruded at the same time.

If a number of nozzles are provided, preferably 1 to 20, in particular 3 to 8, nozzles through which the respective polymer material can be extruded are arranged next to one another per centimetre.

The solidifying, in particular crosslinking, of the first and/or second polymer material may take place for example by thermal exposure and/or by electromagnetic radiation, for example infrared radiation (IR radiation) or ultraviolet radiation (UV radiation), and/or by chemical activation.

It should generally be noted that there are a number of possibilities for the sequence of the process steps. It should also generally be noted that process steps a) and b) always represent the first steps, which are then directly followed by steps c) and/or d). It should also generally be noted that process step f) is preferably always performed after process steps e1) to e3).

It is thus conceivable for example that process steps e1) to e3) are performed at the same time, i.e. the solidifying of the two polymer materials and their material-bonded connection take place at the same time.

To increase the strength of the connection between the first material strands and the second material strands and/or drops, it may be advisable if, in addition to the material-bonded connection, they are also form-lockingly connected. This may for example take place during the solidifying of the polymer materials, by these materials being pressed into one another. A preferred refinement of the process according to the invention therefore provides that, in process step e1) and/or e2), a form-locking connection between the first material strands and the second material strands and/or drops additionally also takes place at the contact points.

Further possible ways of conducting the process are conceivable; it is thus conceivable for example that first process steps c) and d) and then process steps e) and f) are carried out (note: e) comprises process steps e1) to e3)). As an alternative to this, it is conceivable that, after process step c), process step e1) is carried out, then process step d) and after that process step e2).

In order to be able to absorb the tensile forces occurring in the machine with reduced elongation of the grid structure, a preferred refinement of the invention provides that the first material strands extend in a straight line in their length. Furthermore, it may be advisable in this connection if the first material strands extend at an angle of at most 15°, in particular at most 10°, obliquely to the lengthwise direction of the clothing or basic structure.

Depending on the specific requirements for the clothing according to the invention, the distance (=clearance) between two neighbouring first material strands may be different. It is particularly conceivable in this connection that two neighbouring first material strands are spaced 0.1 to 20 millimetres, with preference less than 10 millimetres, particularly less than 5 millimetres, apart from one another in the widthwise direction. The first material strands and/or the second material strands and/or drops may in particular have a height of 0.1 to 5 millimetres, in particular 0.5 to 2.0 millimetres.

Furthermore, a second material strand or a number of second material strands and/or drops may extend between two neighbouring first material strands. Specifically, for example, between every two neighbouring first material strands there may run a second material strand, which progresses in the lengthwise direction of the clothing while following a zigzag pattern or a serpentine pattern and runs back and forth alternately between the two first material strands and is connected in a material-bonded manner to the two first portions of material at contact points. Furthermore, it is also conceivable that between every two neighbouring first material strands there run a number of second material strands and/or drops, which are arranged next to one another in the lengthwise direction of the clothing and extend in their length respectively from one to the other of the two first material strands.

To produce a zigzag pattern or a serpentine pattern, it is conceivable for example that, while the second polymer material is being extruded, the at least one nozzle oscillates back and forth in the second direction and the depositing band or the depositing roller runs around in the circumferential direction.

The second material strands and/or drops may extend here between the first material strands without crossing them. For this purpose, it is necessary in the production of the grid structure that the second material strands and/or drops are deposited between the first material strands.

It is also conceivable that the second material strands extend between the first material strands and cross them. For this purpose, it is necessary in the production of the grid structure that the second material strands are deposited on the depositing surface in a manner crossing the first material strands. In the last-mentioned case, the second material strands may also extend in their length in the widthwise direction of the clothing over more than two first material strands.

It is also conceivable that one or more second material strands and/or drops extend between two neighbouring first material strands.

The second material strands extending between the first material strands may form a right angle with their lengthwise direction in relation to the lengthwise direction of the first material strands.

Furthermore, the first and/or second material strands may have a rectangular or round cross-sectional form.

It is of advantage in particular if the first and/or second polymer material is formed by PET and/or PU and/or silicone and/or PA and/or PPS and/or PEEK. The aforementioned materials can be easily extruded and provide good properties for use in clothings with regard to abrasion resistance, hydrolysis resistance, elasticity and the like.

Depending on the specific application of the clothing, it is conceivable that the first and second polymer materials are the same polymer material or that the first and second polymer materials are different polymer materials.

To increase the stability in the lengthwise direction of the clothing, it may be advisable in particular if the first material strands comprise at least one yarn and/or at least one filler in fibre form and/or particle form, which is or are at least in some portions embedded in the first polymer material.

To produce such a reinforcement with yarn, it is for example conceivable that the respective first material strand is produced by the at least one yarn being respectively extruded in the solid state together with the first polymer material in the liquid or pasty state through one of the at least one nozzles. The filler in fibre form and/or particle form may also be introduced into the compound to be extruded of the liquid first polymer material and be mixed into this compound.

To increase the stability in the widthwise direction of the clothing, it may be advisable in particular if the second material strands comprise at least one yarn and/or at least one filler in fibre form and/or particle form, which is or are at least in some portions embedded in the first polymer material. As an alternative or in addition, it may be advisable if the second material drops that are present as an alternative or in addition to the second material strands comprise at least one filler in fibre form and/or particle form, which is or are at least in some portions embedded in the first polymer material.

The second material strands and/or drops can be produced by analogy with the ways of carrying out the production of the reinforced first material strands.

A yarn is intended in the present case to be understood as meaning a linear textile formation of which the length is at least 30 centimetres. A filler in fibre form is intended in the present case to be understood as meaning a linear textile formation of which the length is at most 10 centimetres, in particular at most 2 centimetres.

The at least one yarn is preferably formed by at least one stretched monofilament or multifilament. It is conceivable in particular that the at least one yarn comprises or is formed from a polymer material, such as for example PE, PET, PA, PPS, PEEK or glass or carbon or aramid or a combination thereof. The filler in fibre form or particle form may likewise comprise or be formed from the aforementioned materials.

The grid structure may for example be formed as open in the lengthwise direction of the clothing, with a transverse edge at one end—as seen in the lengthwise direction of the grid structure—and a transverse edge at the other end. In the case of such a grid structure, for example, each first material strand extends in its length over the length of the grid structure and the basic structure has in addition to the grid structure a seam connecting means, by which the basic structure can be made continuous, by the two transverse edges being brought together and connected to one another by means of the seam connecting means. The seam connecting means may in this case be configured for example in the manner described in German Patent Application No. 10 2013 215 779.7. It goes without saying however that other possibilities for the formation of the seam element are also conceivable.

In the production of the grid structure, it is conceivable that the first material strands are extruded at the same time over the intended width of the grid structure. As an alternative to this, it is conceivable that the first material strands are extruded at the same time only over part of the intended width of the grid structure. Preferably, it is provided in particular that in each case only a portion of the grid structure, with respect to the intended width and/or length of the grid structure to be produced, is extruded or extruded, solidified and connected in a material-bonded manner before another portion of the grid structure adjoining thereto is extruded or extruded, solidified and connected in a material-bonded manner.

As an alternative to this, it is conceivable that the first and second material strands are deposited onto the depositing band or the depositing roller while thereby forming the at least one portion of the grid structure and are only removed from it again at the earliest after completion of one circulation of the depositing band or one revolution of the depositing roller. This allows the grid structure to be produced as a continuous band.

For the production of the grid structure, it is conceivable that the first and second material strands are deposited onto the depositing band or the depositing roller while thereby forming the at least one portion of the grid structure and are removed from it again before completion of one circulation of the depositing band or one revolution of the depositing roller.

After removal from the depositing band or the depositing roller, the grid structure may be wound up on a roller. Such a grid structure in the form of rolled stock can thereafter be made to the desired length and/or width and subsequently processed further.

The at least one grid structure in band form may be produced with a length and/or width that corresponds at least to the length and/or width of the basic structure to be produced. The at least one grid structure in band form may however also be produced with a smaller length and/or width than the basic structure to be produced.

In a case in which the grid structure has for example a greater length and/or width than the basic structure to be produced, the grid structure may be made to the length and/or width of the basic structure.

The grid structure may for example be produced or formed continuously, with a length and width that correspond to the length and width of the basic structure. In this case, various possibilities are conceivable.

Thus, for example, it is conceivable in this connection that each first material strand runs helically in its length and forms turns that run around in the lengthwise direction of the clothing and progress in the widthwise direction of the clothing. To produce the helical structure, it is conceivable for example that, while the first polymer material is being extruded, the at least one nozzle moves in the second direction and the depositing band or the depositing roller runs around a number of times, so that the first material strands together form a helical structure, with turns that run in the circumferential direction of the depositing band or the depositing roller and progress in the second direction or widthwise direction.

Furthermore, it is for example conceivable that each first material strand forms in its length a loop that runs around in a closed manner in the lengthwise direction of the clothing, and the individual loops are arranged next to one another in the widthwise direction of the clothing. To produce such a structure, it is for example conceivable that the first material strands are deposited onto the depositing band or the depositing roller in such a way that each first material strand forms a loop that runs around in a closed manner in the circumferential direction of the depositing band or the depositing roller, the individual loops being arranged next to one another in the second direction. For this purpose, during the production of each first material strand, the at least one nozzle and the depositing band or the depositing roller are not moved in the widthwise direction in relation to one another, while the depositing band or the depositing roller runs around at least once in the circumferential direction.

If the grid structure is produced flat, with at least the length and/or width of the basic structure, it may thereafter be made to the length and/or width of the basic structure and, to make it continuous, the two transverse edges that are spaced apart from one another in the lengthwise direction are brought together and the transverse edges connected by means of a seam connecting means. In this case, the grid structure is for example in the form of rolled stock.

If the grid structure is for example produced with a smaller width than the basic structure, it is generally in the form of rolled stock. Various possibilities are conceivable in this case for the forming of the basic structure.

If the width of the grid structure in band form is smaller than that of the basic structure to be produced, the grid structure in band form may be wound helically, with turns that run around in the lengthwise direction of the basic structure and progress in the widthwise direction of the basic structure.

As an alternative to this, the basic structure may comprise or be formed from a number of strips of the grid structure in band form that are disposed next to one another in the widthwise direction of the basic structure. For this purpose, for example, a number of strips in band form of the grid structure, the length of which corresponds to the length or substantially corresponds to the length of the basic structure to be produced, are provided in a first step. In a second step, these strips are then placed against one another along their longitudinal edges and connected to one another.

In a further step, the two transverse edges of the structure created in the previous step are then brought together and connected to one another directly or by means of a seam connecting means.

The grid structure may however also be produced as a continuous loop with a smaller width than the basic structure. In this case, the grid structure is not in the form of rolled stock. In this connection it is conceivable for example that the basic structure comprises or is formed from a number of continuous loops of the grid structure in band form, which are disposed next to one another in the widthwise direction of the basic structure. For this purpose, for example, the continuous loops of the grid structure in band form are placed against one another along their longitudinal edges and connected to one another.

Furthermore, the basic structure may be formed by the grid structure. This is the case for example whenever the basic structure is formed by a helically wound grid structure.

Specifically, the clothing may be substantially formed by the basic structure. The term "substantially" is intended here to indicate that the clothing has no further layers that are arranged on the upper side and/or underside of the grid structure. This means that, when the transporting band is used as intended, the upper side of the grid structure provides the paper side that can be brought into contact with the fibrous web and the underside of the grid structure provides the machine side that can be brought into contact with the machine. The transporting band may comprise further components, such as for example a seam connecting means, for example in the form of two seam spirals and a connecting pintle wire, or the like.

Specifically, the transporting band may be for example a dryer fabric or a forming fabric for a paper, board or tissue machine.

As an alternative to what has been said above, the clothing may comprise the basic structure and also at least one layer of fibrous nonwoven and/or foam material. In this case, the transporting band is not substantially provided by the basic structure, but instead also has in addition to the basic structure at least one layer of fibrous nonwoven and/or foam material, which is arranged on the upper side and on the underside of the grid structure. In this case, the clothing may for example be a press felt for a paper, board or tissue machine.

BRIEF DESCRIPTION OF THE SEVERAL VIEWS OF THE DRAWING

The invention is further explained below on the basis of schematic drawings, in which.

DESCRIPTION OF THE INVENTION

Figure 1:
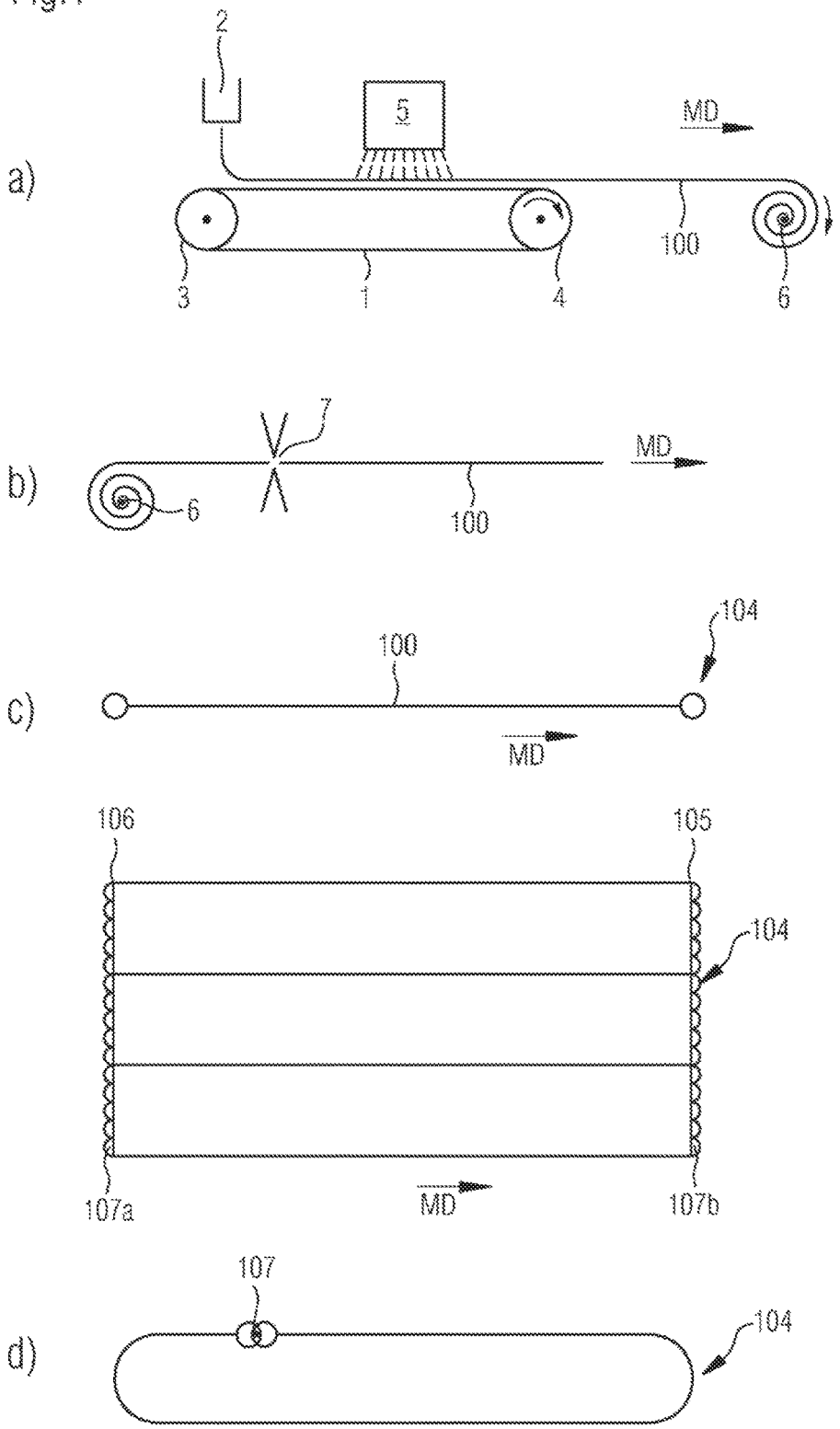
FIG. 1 shows a first embodiment of the process according to the invention for producing the clothing according to the invention.

FIG. 1 shows a first embodiment of the process according to the invention for producing the clothing according to the invention.

At a first processing station, shown in FIG. 1*a*, a grid structure 100 is produced by a process comprising the following steps. The working station shown in FIG. 1*a* for extruding the grid structure 100 is represented in plan view in FIG. 2.

A depositing surface is provided, formed in the present case by a depositing band 1 and having an extent in a first direction and a second direction, in the present case the circumferential direction of the depositing band 1 extending in some portions in the first direction and the second, substantially in the widthwise direction CD of the grid structure to be produced. The depositing band 1 is led around a roller arrangement formed by two rollers 3, 4 that are spaced apart from one another.

The first direction extends substantially in the lengthwise direction MD of the grid structure 100 to be produced.

A first and a second polymer material are provided in a liquid or pasty state and can be extruded onto the depositing band 1 by means of an extrusion device 2 comprising a multiplicity of nozzles 2*a*, 2*b*.

In the present case, the first and second polymer materials are the same polymer material, to be specific polyurethane.

The extrusion device 2 may comprise here a number of first nozzles 2*a*, arranged next to one another in the second direction, and also a number of second nozzles 2*b*, arranged next to one another in the second direction.

By means of the first nozzles 2*a*, the first polymer material is extruded in the liquid state onto the depositing band 1 in such a way that on the depositing surface 1 there are formed a multiplicity of first material strands 101, which are arranged next to one another in the second direction and are spaced apart from one another and in their length respectively extend substantially in the first direction MD.

By means of the second nozzles 2*b*, the second polymer material is extruded in such a way that on the depositing surface 1 there are formed a multiplicity of second material strands 102, which are spaced apart from one another and contact the first material strands 101 at contact points and are connected to one another in such a way that the first material strands 101 and the second material strands 102 together form the grid structure 100.

In the extrusion process, the two polymer materials are extruded by means of the nozzles 2*a*, 2*b*, the first and/or second nozzles 2*a*, 2*b* and the depositing surface 1 being moved in relation to one another in the first and/or second direction during the extrusion. This takes place by the depositing band 1 on the one hand running around in its circumferential direction during the extrusion and the first nozzles 2*a* not moving, whereby the first material strands 101 extending in the first direction MD are formed, and also by the depositing band 1 on the one hand running around in its circumferential direction during the extrusion and the second nozzles 2*b* moving back and forth in an oscillating manner in the second direction CD, whereby the second material strands 102 are created, extending in zigzag lines between the first material strands 101 but not crossing the first material strands 101.

In the present case, the second material strands 102 extend in zigzag lines between the first material strands 101, the second material strands 102 not crossing the first material strands. In the present case, the first and second material strands 101, 102 are applied on the depositing band 1 at the same time.

Furthermore, the first and second material strands 101, 102 are extruded at the same time over the intended width of the grid structure 100, the width of the grid structure 100 being less than the width of the basic structure 104 to be produced.

The respective first material strand 101 is produced in the present case by at least one yarn being respectively extruded in the solid state together with the first polymer material in the liquid state through one of the nozzles. Formed as a result are first material strands 101, which respectively comprise at least one yarn, the at least one yarn of the respective material strand being at least partially enclosed by the first polymer material at least in some portions, in particular over its entire length. The at least one yarn may contain here at least one stretched monofilament or a multifilament or be provided thereby.

After the extrusion process, the portion of the grid structure 100 that is still in a liquid or pasty, and therefore unstable, state is transformed by means of a solidifying device 5 into a solidified and self-supporting state by solidifying the first and second polymer materials and bringing about a material-bonded connection between the first and second polymer materials at the contact points. The solidifying of the first and second polymer materials may be brought about here by thermal exposure and/or by electromagnetic radiation and/or by chemical activation. The solidifying of the two polymer materials and their material-bonded connection at the contact points can take place here at the same time.

After the portion of the grid structure 100 has solidified, it is removed from the depositing band 1 and fed to a roller 6 and wound up on it. By the process described here, the grid structure is produced as rolled stock.

In the present case, the grid structure 100 has a width that is smaller than the width of the basic structure 104 to be produced. For this reason, in the processing steps that are shown in FIGS. 1*b* and 1*c* the grid structure 100 created and in the form of rolled stock is further processed to form the basic structure 104. For this purpose, the grid structure 100 is first made to the required length with a cutting unit 7 (see FIG. 1*b*) and subsequently the strips obtained from it are arranged next to one another in the widthwise direction of the basic structure 104 to be produced, along their longitudinal edges, and are connected to one another. This produces a flat-formed intermediate product made up of a number of strips of the grid structure 100, with a transverse edge 105 at one end and a transverse edge 106 at the other end. To form the basic structure 104, a seam connecting means 107 comprising the seam connecting elements 107*a*, 107*b* is arranged at the two transverse edges. To make the basic structure 104 continuous, the two transverse edges 105, 106 are brought together and connected to one another by means of the seam connecting means 107 107, as is shown in FIG. 1*d*.

Figure 3:
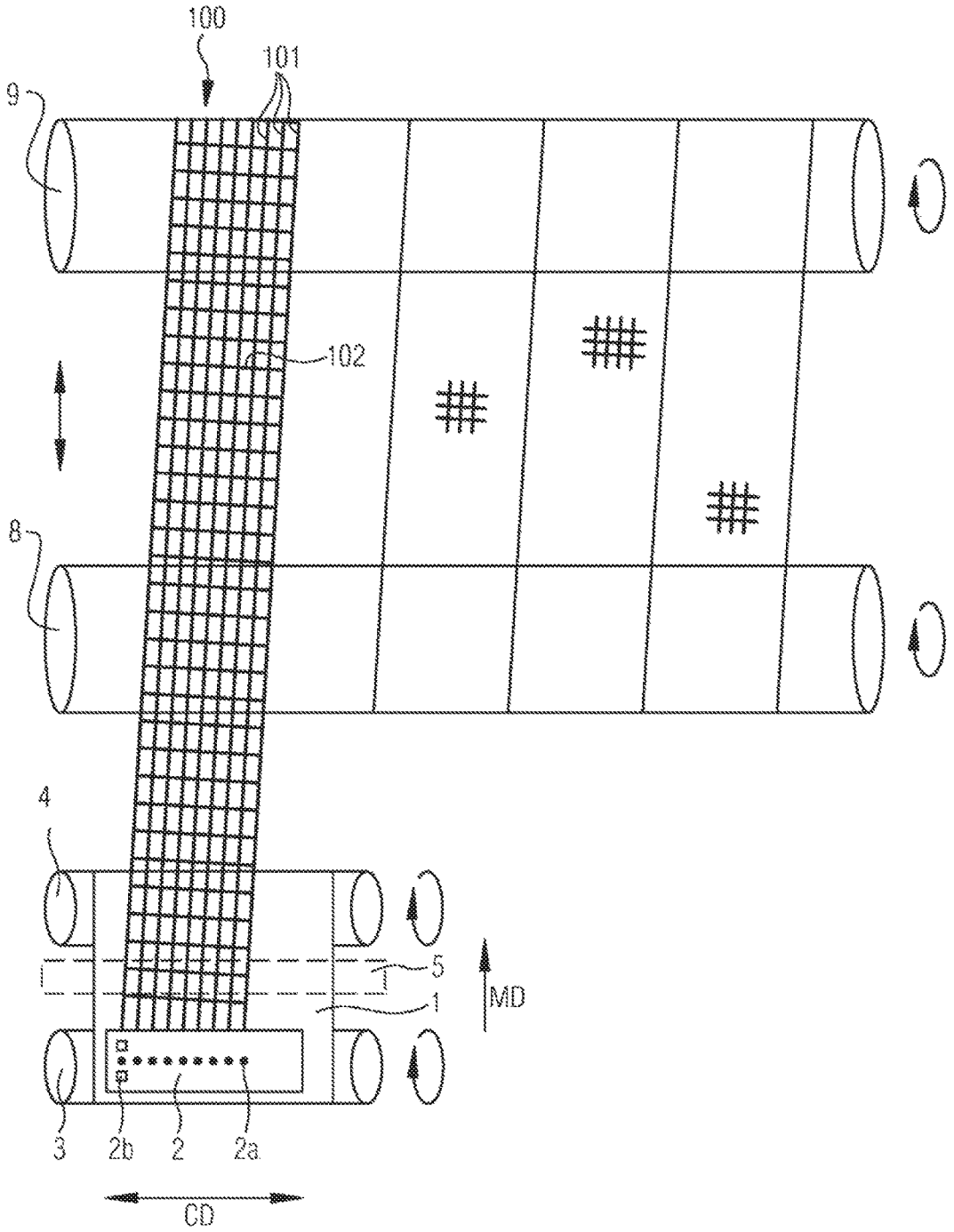
FIG. 3 shows a second embodiment of a partial aspect for the production of a grid structure or part thereof.

In the extrusion process and subsequent solidifying process shown in FIG. 3, a grid structure 100 is likewise created, the width of which is smaller than the width of the basic structure 104 to be produced. To produce the basic structure 104 with the desired width and length, directly following the creation of the grid structure 100 for this purpose the grid structure 100 is wound helically around two rollers 8, 9 spaced apart from one another, with turns that run around in the circumferential direction MD of the basic structure 104 and progress in the widthwise direction CD of the basic structure 104.

Figure 2:
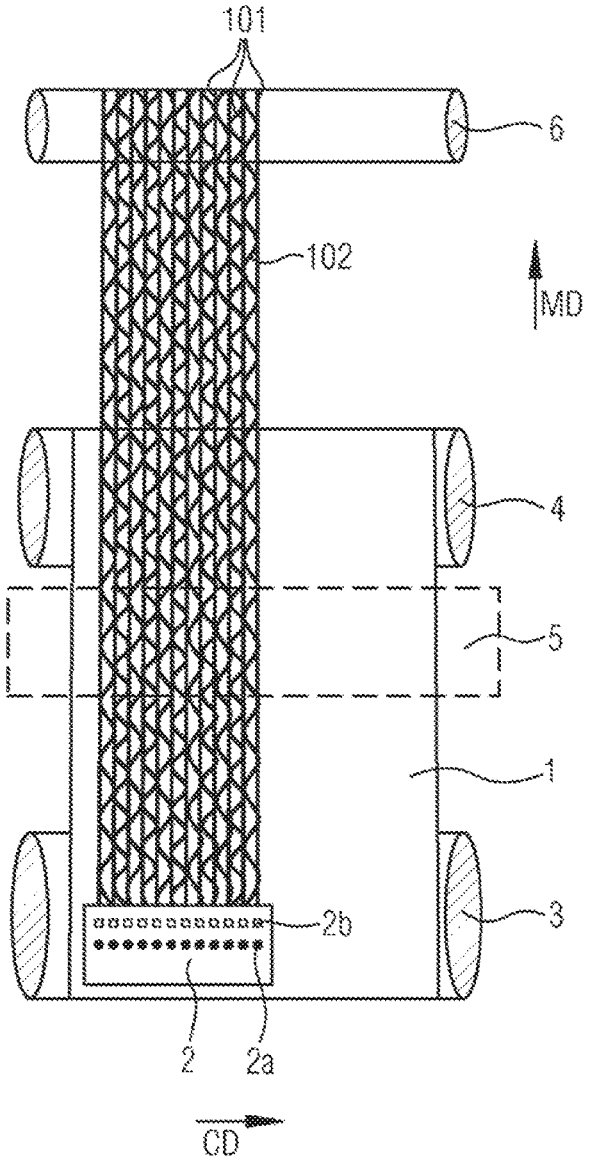
FIG. 2 shows a first embodiment of a partial aspect for the production of a grid structure or part thereof.

To produce the grid structure 100 of FIG. 3, as in the case of the exemplary embodiment of FIG. 2, a first and a second polymer material are provided in a liquid or pasty state and extruded onto the depositing band 1 by means of an extrusion device 2 comprising a multiplicity of nozzles 2*a*, 2*b*.

In the present case, the extrusion device 2 comprises a number of first nozzles 2*a*, arranged next to one another in the second direction CD, and also a number of second nozzles 2*b*, arranged next to one another in the first direction MD.

By means of the first nozzles 2*a*, the first polymer material is extruded in the liquid state onto the depositing band 1 in such a way that on the depositing surface 1 there are formed a multiplicity of first material strands 101, which are arranged next to one another in the second direction and are spaced apart from one another and in their length respectively extend substantially in the first direction MD.

By means of the second nozzles 2*b*, the second polymer material is extruded in such a way that on the depositing surface 1 there are formed a multiplicity of second material strands 102, which are spaced apart from one another in the first direction and contact and cross over the first material strands 101 at contact points and are connected to one another in such a way that the first material strands 101 and the second material strands 102 together form the grid structure 100.

In the extrusion process, the two polymer materials are extruded by means of the nozzles 2*a*, 2*b*, the first and/or second nozzles 2*a*, 2*b* and the depositing surface 1 being moved in relation to one another in the first and/or second direction during the extrusion. This takes place by the depositing band 1 on the one hand running around in its circumferential direction during the extrusion and the first nozzles 2*a* not moving, whereby the first material strands 101 extending in the first direction MD are formed, and also by the depositing band 1 on the one hand running around in its circumferential direction during the extrusion and the second nozzles 2*b* moving from left to right in the second direction CD over the intended width of the grid structure 100 to be produced, whereby the second material strands 102 are created, running in CD and crossing the first material strands 101.

Furthermore, the first and second material strands 101, 102 are extruded at the same time over the intended width of the grid structure 100, the width of the grid structure 100 being less than the width of the basic structure 104 to be produced.

Figure 4:
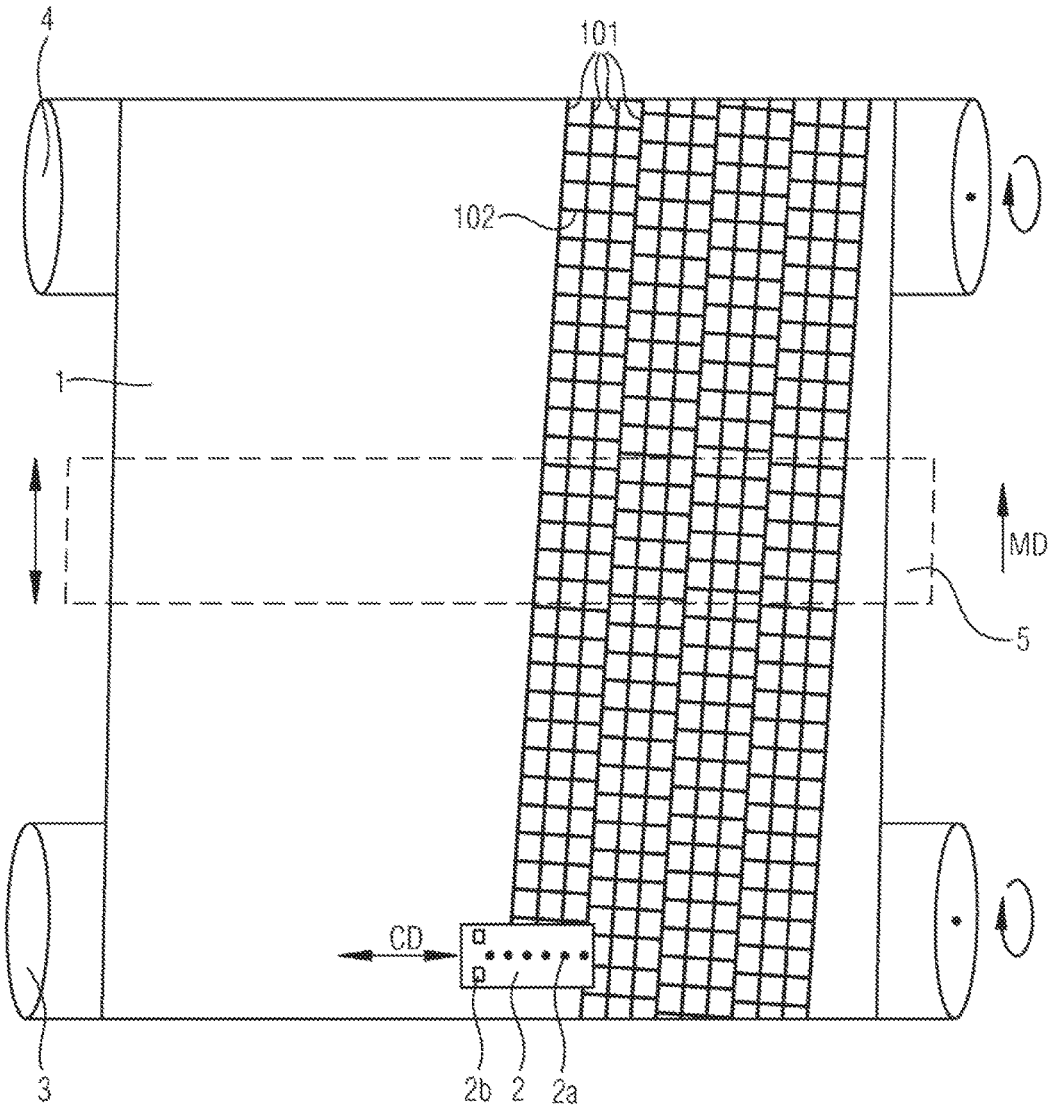
FIG. 4 shows a third embodiment of a partial aspect for the production of a grid structure or part thereof.

In the extrusion process and subsequent solidifying process shown in FIG. 4, a grid structure 100 is created, the width of which is equal to the width of the basic structure 104 to be produced.

Furthermore, the first and second material strands 101, 102 are extruded at the same time over only part of the intended width of the grid structure 100.

For this purpose, the grid structure 100 is extruded helically on a depositing surface formed by a depositing band 1 and subsequently solidified, until a grid structure 100 with the width and length of the basic structure 104 is created, before the grid structure 100 is removed from the depositing band 1. While the first polymer material is being extruded, the first nozzles 2*a* moves in the second direction CD, either only from left to right or only from right to left, i.e. without oscillation, while the depositing band 1 runs around a number of times in the circumferential direction MD, so that the first material strands 101 together form a helical structure, with turns that run in the circumferential direction of the depositing band 1 and progress in the second direction CD.

Figure 5:
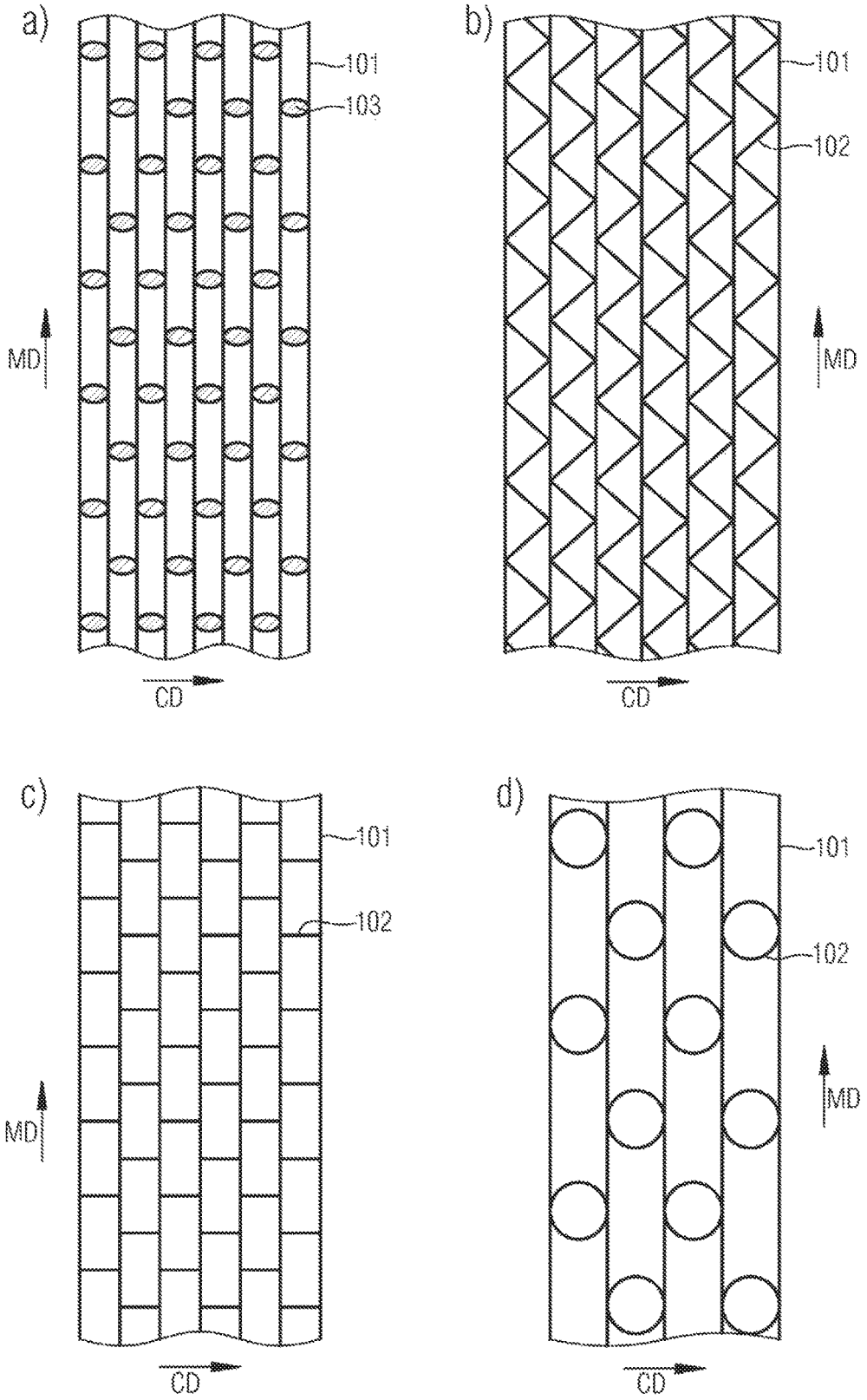
FIG. 5 shows various refinements of the grid structure of the clothing according to the invention in plan view and FIG. 6 shows various refinements of the cross-sectional form of the grid structure of the clothing according to the invention.

FIG. 5 shows various embodiments of grid structures 100 according to the invention in plan view.

The grid structure 100 of FIG. 5*a* is formed by first material strands 101 and second material drops 103, which are connected to and extend between the first material strands 101 but do not cross them.

The grid structure 100 of FIG. 5*b* is formed by first material strands 101 and second material strands 102, which are connected to and extend in zigzag lines between the first material strands 101 but do not cross them.

The grid structure 100 of FIG. 5*c* is formed by first material strands 101 and second material strands 102, which are connected to and extend between the first material strands 101, perpendicularly thereto, but do not cross them.

The grid structure 100 of FIG. 5*d* is formed by first material strands 101 and second material strands 102, which are connected to and extend between the first material strands 101 in a circular manner but do not cross them.

Figure 6:
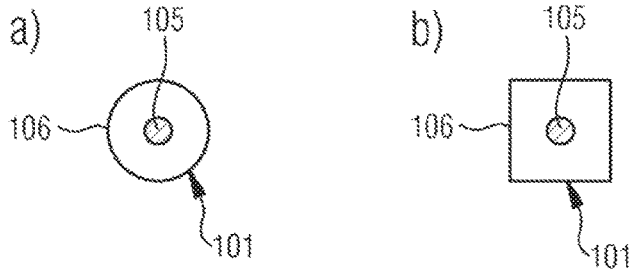

FIG. 6*a* shows refinements of the cross-sectional form of the first material strands 101 of the grid structure 100 of the clothing according to the invention. The first material strand 101, shown in FIG. 6*a*, has a circularly round cross-sectional form with a monofilament yarn 105, which is completely embedded in the first polymer material 106. The first material strand 101 shown in FIG. 6*b* has a rectangular cross-sectional form with a monofilament yarn 105, which is completely embedded in the first polymer material 106.

The invention claimed is:

1. A clothing to be used in a machine for at least one of producing or processing a fibrous web extending in lengthwise and widthwise directions, the clothing comprising:

a basic structure substantially providing dimensional stability of the clothing in at least one of the lengthwise or widthwise directions when used as intended, said basic structure having a band-shaped, one-piece grid structure with an upper side being a paper contacting side and an underside being a machine contacting side;

said grid structure including a plurality of first material strands disposed next to one another in the widthwise direction of the clothing and a first polymer material, said first material strands having a length extending substantially in the lengthwise direction of the clothing, and a plurality of at least one of second material strands or drops disposed next to one another and a second polymer material;

said at least one of second material strands or drops directly contacting said first material strands at contact points and being connected to one another causing said first material strands and said at least one of second material strands or drops to form said grid structure together; and said grid structure having characteristic of having been produced by:

a) depositing said first material strands and said at least one of second material strands or drops in a liquid or pasty state by extrusion of said first and second polymer materials in a liquid or pasty state onto a depositing surface to form at least one portion of said grid structure or to form said grid structure, b) solidifying said first and second polymer materials by transforming said at least one portion of said grid structure or said grid structure from a liquid or pasty state into a solidified stable and self-supporting state and establishing a material-bonded connection at said contact points, and c) removing said at least one portion of said solidified grid structure or said grid structure from the depositing surface.

2. The clothing according to claim 1, wherein at least one of:

said first material strands or said at least one said second material strands or drops, are formed of at least 60% by weight of said polymer material.

3. The clothing according to claim 1, wherein at least one of:

said first material strands or said at least one said second material strands or drops, are formed of at least 80% by weight of said polymer material.

4. The clothing according to claim 1, wherein said lengths of said first material strands extend in a straight line.

5. The clothing according to claim 1, wherein:

said grid structure is continuously closed in the lengthwise direction of the clothing; and each of said first material strands runs helically along its length with turns running around in a lengthwise direction of said basic structure and progressing in a widthwise direction of said basic structure.

6. The clothing according to claim 1, wherein:

said grid structure is continuously closed in the lengthwise direction of the clothing;

each of said first material strands forms a loop in its length running around in a closed manner in the lengthwise direction of the clothing; and said loops are individually disposed next to one another in a widthwise direction of said basic structure.

7. The clothing according to claim 1, wherein:

said basic structure is open in the lengthwise direction of the clothing and has two ends, a transverse edge at one of said ends and a transverse edge at the other of said ends;

each of said first material strands extends along its length over a length of said basic structure; and said basic structure includes, in addition to said grid structure, a seam connecting device for making said basic structure continuous by bringing together and interconnecting said transverse edges of said grid structure at said seam connecting device.

8. The clothing according to claim 1, wherein at least some of said at least one of second material strands or drops extend between said first material strands without crossing said first material strands, or at least some of said second material strands cross said first material strands.

9. The clothing according to claim 8, wherein said at least some of said second material strands cross said first material strands at right angles.

10. The clothing according to claim 1, wherein said first and second polymer materials are the same polymer material or said first and second polymer materials are different polymer materials.

11. The clothing according to claim 1, wherein at least one of said first material strands or said second material strands contains at least one respective yarn having at least some portions being at least partially enclosed by said first or second polymer material.

12. The clothing according to claim 1, wherein said grid structure has a smaller width than said basic structure or said grid structure has the same width as said basic structure.

13. The clothing according to claim 1, wherein said grid structure has a smaller width than said basic structure and said grid structure runs in a helically wound manner with turns running around in a lengthwise direction of said basic structure and progressing in a widthwise direction of said basic structure.

14. A process for producing a clothing for a machine for at least one of producing or processing a fibrous web, the process comprising the following steps:

providing the clothing with a basic structure substantially providing dimensional stability of the clothing in at least one of a lengthwise direction or a widthwise direction when used as intended;

providing the basic structure with a band-shaped, one-piece grid structure including an upper side being a paper contacting side, an underside being a machine contacting side, a plurality of first material strands disposed next to one another in the widthwise direction of the clothing, having a first polymer material and having a length extended substantially in the lengthwise direction of the clothing, and a plurality of at least one of second material strands or drops disposed next to one another, having a second polymer material, directly contacting the first material strands at contact points and being connected to one another causing the first material strands and the at least one of second material strands or drops to form the grid structure together; and producing the grid structure by:

a) providing a depositing surface having a first direction and a second direction, b) providing the first and second polymer materials in a liquid state, c) extruding the first liquid polymer material by using at least one nozzle to form on the depositing surface a multiplicity of the first material strands disposed next to one another in the second direction, being spaced apart from one another and having a length respectively extending substantially in the first direction, d) extruding the second liquid polymer material by using at least one nozzle to form on the depositing surface a multiplicity of at least one of the second material strands or the drops being disposed next to one another in the first direction, being spaced apart from one another, contacting the first material strands at contact points and being connected to one another causing the first material strands and the at least one of second material strands or drops to form at least one portion of the band-shaped and one-piece grid structure together, e) transforming the at least one portion of the grid structure from a liquid or pasty and unstable state into a solidified and self-supporting state by:

1) solidifying the first polymer material, 2) solidifying the second polymer material, and 3) bringing about a material-bonded connection between the first and second polymer materials at the contact points; and f) removing the at least one portion of the solidified band-shaped and one-piece grid structure from the depositing surface.

15. The process according to claim 14, which further comprises moving the at least one nozzle and the depositing surface relative to one another in at least one of the first or second directions during the extrusion of the first and second polymer materials by using the at least one nozzle.

16. The process according to claim 14, which further comprises performing steps e1) to e3) simultaneously.

17. The process according to claim 14, which further comprises performing steps e1) and e2) or steps e2) and e3) simultaneously.

18. The process according to claim 14, which further comprises additionally providing a form-locking connection between the first material strands and the at least one of second material strands or drops at the contact points in at least one of step e1) or e2).

19. The process according to claim 14, which further comprises performing step c), then step e1), then process step d) and then step e2).

20. The process according to claim 14, which further comprises providing the depositing surface as a depositing band or a depositing roller having a circumferential direction extending in the first direction, the band or roller running around in its circumferential direction during the extrusion.

21. The process according to claim 14, wherein the first direction is substantially a lengthwise direction and the second direction is substantially a widthwise direction of the grid structure.

22. The process according to claim 20, which further comprises, while extruding the first polymer material, moving the at least one nozzle in the second direction and running the depositing band or the depositing roller around a plurality of times, causing the first material strands to form a helical structure together, with turns running in a circumferential direction of the depositing band or the depositing roller and progressing in the second direction.

23. The process according to claim 20, which further comprises depositing the first material strands onto the depositing band or the depositing roller together to form at least one helix having turns running around in a circumferential direction of the depositing band or the depositing roller and progressing in the second direction.

24. The process according to claim 20, which further comprises depositing the first material strands onto the depositing band or the depositing roller causing each first material strand to form a loop running around in a closed manner in a circumferential direction of the depositing band or the depositing roller and placing the loops individually next to one another in the second direction.

25. The process according to claim 14, which further comprises, while extruding the second polymer material, moving the at least one nozzle back and forth in an oscillating manner in the second direction and running the depositing band or the depositing roller around in a circumferential direction.

26. The process according to claim 14, which further comprises extruding the first material strands simultaneously over an intended width of the grid structure or extruding the first material strands simultaneously over only part of the intended width of the grid structure.

27. The process according to claim 20, which further comprises depositing the first and second material strands onto the depositing band or the depositing roller while forming the at least one portion of the grid structure and removing the first and second material strands from the depositing band or the depositing roller again before completion of one circulation of the depositing band or one revolution of the depositing roller.

* * * * *